US008356918B2

(12) United States Patent
Allen et al.

(10) Patent No.: US 8,356,918 B2
(45) Date of Patent: Jan. 22, 2013

(54) COMPACT BEAM FORMER FOR INDUCTION HID LAMP

(75) Inventors: Gary Robert Allen, Chesterland, OH (US); Viktor Karoly Varga, Solon, OH (US); David C. Dudik, South Euclid, OH (US)

(73) Assignee: General Electric Company, Schenectady, NY (US)

( * ) Notice: Subject to any disclaimer, the term of this patent is extended or adjusted under 35 U.S.C. 154(b) by 616 days.

(21) Appl. No.: 12/609,960

(22) Filed: Oct. 30, 2009

(65) Prior Publication Data

US 2010/0110694 A1 May 6, 2010

Related U.S. Application Data

(60) Provisional application No. 61/110,390, filed on Oct. 31, 2008.

(51) Int. Cl.
*F21V 13/00* (2006.01)

(52) U.S. Cl. ..... 362/297; 362/263

(58) Field of Classification Search ..... 362/263, 362/297
See application file for complete search history.

(56) References Cited

U.S. PATENT DOCUMENTS

| | | | | |
|---|---|---|---|---|
| 6,217,197 | B1 * | 4/2001 | Siminovitch et al. | 362/297 |
| 7,303,307 | B2 * | 12/2007 | Martin et al. | 362/216 |
| 2003/0067759 | A1 * | 4/2003 | Blanchard | 362/29 |
| 2005/0018430 | A1 * | 1/2005 | Mohacsi | 362/300 |
| 2005/0047139 | A1 * | 3/2005 | Seo | 362/263 |

* cited by examiner

*Primary Examiner* — Laura Tso
(74) *Attorney, Agent, or Firm* — Fay Sharpe LLP

(57) ABSTRACT

A light distribution assembly includes an electrodeless HID light source providing emitted light along substantially first and second hemispherical zones. A first optical element redirects a portion of light from the first hemispherical zone into a first desired direction in the second hemispherical zone. A second optical element redirects at least a portion of light within the second hemispherical zone. Other optical elements may be added to tailor the light distribution. Various combinations of these components may be used to create the desired illumination pattern.

23 Claims, 9 Drawing Sheets

COMPACT BEAM FORMER FOR INDUCTION HID LAMP

This application claims priority from U.S. provisional application Ser. No. 61/110,390, filed 31 Oct. 2008, the entire disclosure of which is expressly incorporated herein by reference.

BACKGROUND OF THE DISCLOSURE

This disclosure relates to an induction or electrodeless high intensity discharge (HID) lamp assembly, and more particularly is directed to an optical assembly for providing a preferred distribution of light output.

In general, optical solutions for light sources must address a myriad of issues. Among these issues is collecting as large a percentage as possible of the light output from the lamp for a particular use. Since the induction HID lamp employs a coil disposed around a zone of the arctube body, the light optics must also address potential light blockage by the coil, be flexible relative to coil geometry and location, and allow for high coil coupling efficiency and high optical efficiency irrespective of the optical design. In traditional HID light sources, such as quartz metal halide (QMH), ceramic metal halide (CMH), or high-pressure sodium (HPS) lamps, the light output is generally in the horizontal or equatorial plane. In the induction HID lamp, light output is generally in the vertical plane, along the apex and nadir of the lighting system. This requires highly specific optical solutions to address potentially high on-axis light directly below the lighting system, which would result in a non-uniform illumination pattern.

Still another issue relates to providing a preferred distribution of light output intensity for coupling into a wide variety of applications. Thus, providing high collection efficiency and providing a light output intensity distribution that is suitable for specific lighting applications is desirable.

Since the induction HID lamp employs an arctube body that is a pressurized vessel, and because of the electromagnetic field associated with operation of this type of lamp, there are additional considerations relating to containment of non-passive failures, shielding against electromagnetic interference, and UV filtering. Incorporating these various needs into the optics is desired, as well as a simple solution that adequately addresses each without adding undue complexity to the geometry of the optics. In one example application of HID lamps, a quartz metal halide light source is associated with large area lighting from extended heights. For example, quartz metal halide light sources are often used to provide parking lot illumination. The lamp is typically mounted at a substantial height at the top of a pole on the order of thirty feet (30'). Moreover, a goal or objective of the light assembly and particularly the optics is to cover a ground footprint of approximately one hundred twenty feet by one hundred twenty feet (120'×120'). There is an additional challenge to provide suitable optics that will illuminate this ground area as uniformly as possible. This illumination can be characterized by a ratio of the maximum illuminance level within the ground footprint divided by the minimum illuminance level within the ground footprint. For traditional HID lighting systems, this ratio is on average 6:1 and at best 3:1. Illumination design takes both the max:min ratio and the minimum illuminance into account. Minimum illuminance levels are required for safety and appearance purposes. Therefore, a low max:min ratio along with a high minimum illuminance level is desired to efficiently illuminate ground applications with the smallest amount of light flux necessary. As will be appreciated, a large amount of the light will have the tendency to illuminate the area directly adjacent the pole, while the challenge is to direct zones of the light output to the more remote areas of the illuminated region and in a generally uniform and highly efficient manner.

The compactness and weight of the electrodeless or induction HID lamp assembly are two key features that require improvement in existing lamp assemblies. By way of example only, approximately three-fourths of the total price of these types of light assemblies is associated with the pole on which the light assembly is mounted. Therefore, being able to decrease the weight of the lamp assembly, and providing a more compact unit that reduces the cross-sectional area of the lamp assembly exposed to the external environment, allows less impact by the wind, lower light system weight, and use of a lighter pole. Dramatic savings could potentially be achieved.

In a second example application of HID lamps, a quartz metal halide light source is associated with spot and flood lighting in sporting arenas or stadia from extended heights. The lamp is typically mounted at a substantial height above the arena or stadium, typically about 100' or more above the lighted surface. In order to provide the preferred distribution of illumination on the lighted surface, each of a large number of light sources is aimed to illuminate a subsection of the total illuminated area. Due to the very long distances over which the light is projected, the angle of each beam of light, and the distribution of light intensity within each beam must be very well controlled. This beam can be characterized by the beam width, typically defined as the full-width at half-maximum (FWHM) of the light intensity distribution in the optical far field. In such applications, the same advantages of the compactness and weight of the induction HID lamp assembly are two key features that enable simpler, lighter, smaller, more efficient, more effective, and less expensive lighting installations than those presently in use.

The induction HID lamp arctube body may be made of quartz, which has limitations in maximum overall wattage, life, and luminous output. Preferably, the lamp arctube body is made of a ceramic material, such as polycrystalline alumina, which will increase the life and luminous output of the lamp, while provide a smaller light source with a more uniform intensity output compared to a quartz lamp.

Accordingly, a need exists for an optical arrangement that adds additional value to the use of induction HID lamps.

SUMMARY OF THE DISCLOSURE

A light distribution assembly includes an electrodeless or induction HID light source providing light emitted into substantially first and second hemispherical zones that are separated by the equatorial plane of the arctube body. A first optical element, such as a first reflector or refractor or diffractor, redirects a first zone of light from the first hemispherical zone into a forward desired direction that is contained within the second hemispherical zone. A second optical element, such as a second reflector or refractor or diffractor, redirects a second zone of light from the second hemispherical zone, possibly including a zone of the light that was redirected by the first optical element, into a forward desired direction that is contained within the second hemispherical zone. A third, or additional optical elements, such as a third reflector or refractor or diffractor, can additionally redirect a second zone of the light in the first hemispherical zone into the second hemispherical zone, or onto the first optical element, in order to tailor the light distribution pattern in the second hemispherical zone. Some of light from the first hemispherical zone that is not redirected by the first or third optical elements may remain within the first hemispherical zone without being redirected, or it may be redirected within the first hemispherical zone or into the second hemispherical zone, by additional optical elements. Various combinations of the three or more optical elements may be used to create a desired illumination pattern. Due to the small size of the electrodeless HID light source in comparison to a traditional HID light source, increased control can be exercised over the light distribution, resulting in many different illumination patterns from small changes in optical element configuration.

In one embodiment, the light distribution assembly provides substantially uniform light distribution with a high minimum illumination level. In this embodiment, the first optical element surrounds the light source and redirects light from the first hemispherical zone in a forward direction in the second hemispherical zone. A second optical element is placed below the lamp to control the light directly emitted from the arctube body into the second hemispherical zone in order to provide more uniform illuminance. Third and additional optical elements can be placed above the lamp to further optimize the light distribution, by redirecting light emitted into the first hemispherical zone from the arctube body either into the second hemispherical zone, or onto the first optical element. This would be useful for area lighting applications, such as outdoor, parking lot, garage, indoor high bay, and other applications where a uniform illuminance is desired.

The light distribution assembly may further include a solid optical block receiving light from the first optical elements. In this embodiment, the first optical element substantially directs the light emitted from the arctube body into the first hemispherical zone in the forward direction, so that a majority of the flux is emitted into the second hemispherical zone.

The optical block has a conformation that mates with an external surface of the second hemispherical zone of the light source.

A second end of the optical block is spaced from the light source and has a convex, concave, or other lens-like surface.

In a preferred arrangement, the first optical element includes a reflective coating on the arctube body that redirects light from the first hemispherical zone back through the arctube body to be re-emitted into the second hemispherical zone. Alternatively, a reflector element positioned in close proximity to the arctube body would provide similar light output to a reflective coating on the arctube body.

A primary advantage is the inclusion of the induction HID light source in a main equatorial reflector with geometrically simple optics above and below the lamp to obtain uniform illuminance on the ground.

Optimally, the disclosure teaches production of a plane of light below the lamp to create a wide variety of beam patterns within the limits of the brightness of the arctube body. The variety of beam patterns can also optimally be created by changing only the first or first and second optical elements, providing for a modular light system.

Due to the small size of the electrodeless HID light source in comparison to a traditional HID light source, the size of the optical system can be reduced proportionally. For outdoor lighting applications, the compact, reduced weight light assembly permits use of a lighter weight pole at a substantial reduction in cost. For indoor lighting applications, benefits of ease of installation and reduced infrastructure cost are enabled.

Similarly, higher efficiency optical coupling, and more effective distribution of the light when compared with traditional HID lighting systems results in fewer fixtures, and fewer poles to provide light to a given area.

Still other features and benefits and of the present disclosure will become apparent from reading and understanding the following detailed description.

DETAILED DESCRIPTION OF THE PREFERRED EMBODIMENTS

Figure 1:
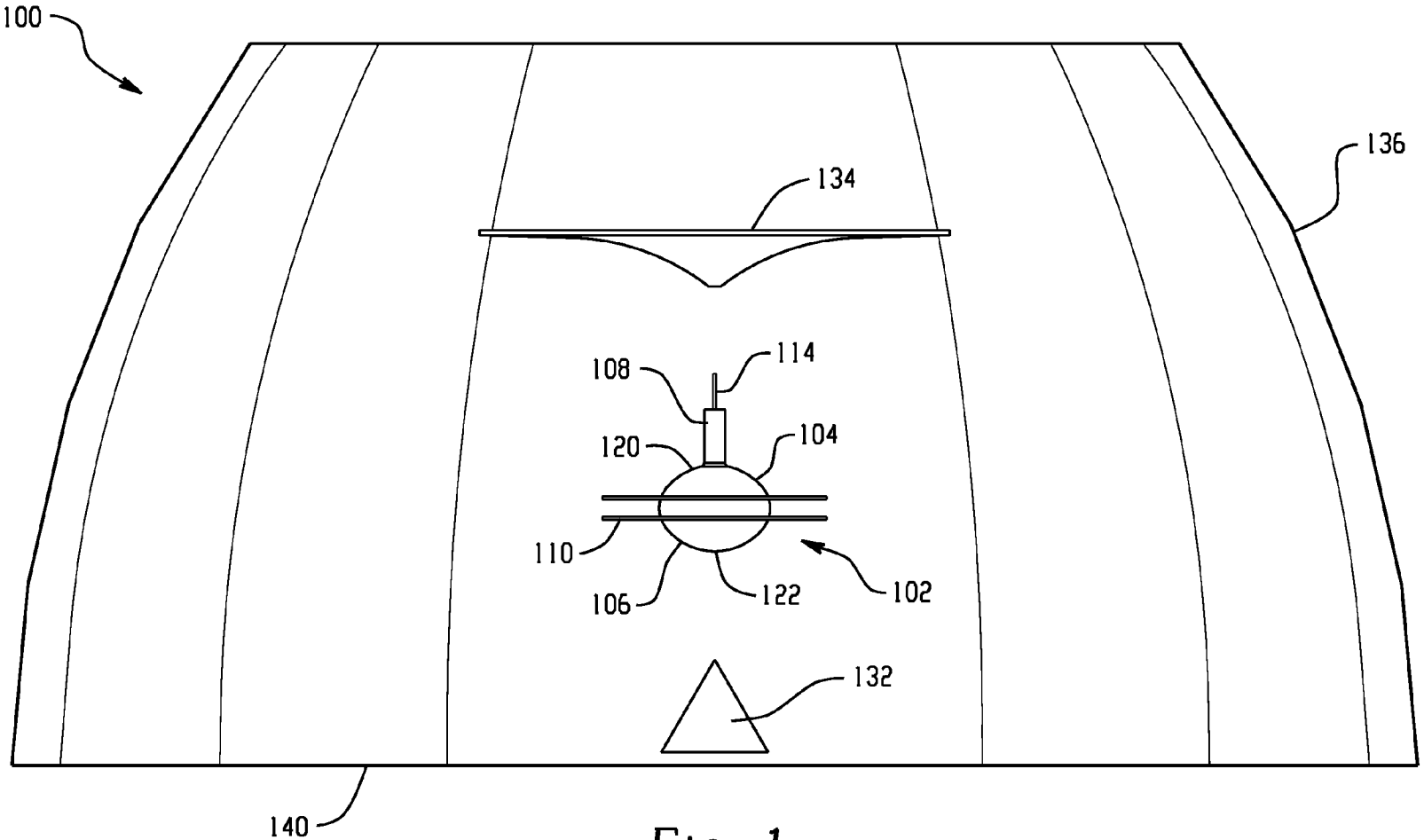
FIG. 1 is an elevational view of a light assembly.
Figure 3:
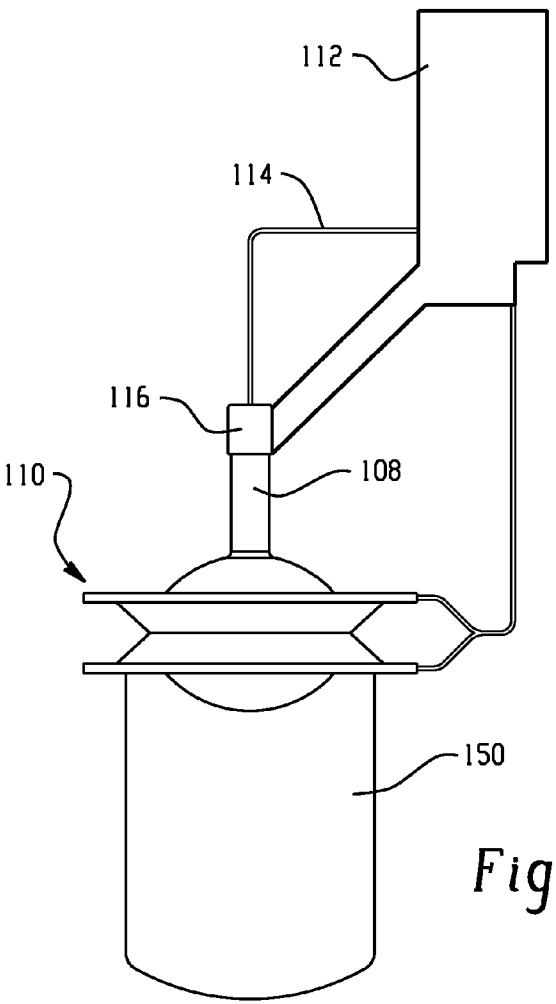
FIG. 3 is an elevational view of the lamp assembly with compact beam forming optics for an electrodeless lamp.

A light assembly 100 is particularly shown in FIG. 1 and includes a light source 102, such as an electrodeless or induction high intensity discharge (HID) light source of the type shown and described in U.S. Pat. Nos. 4,810,938, 4,959,584 and 5,675,677, the details of which are incorporated herein by reference. The light source or lamp includes an arctube body 104 that has a generally spheroidal portion 106 and may include one or more legs 108 extending therefrom (FIG. 3). For example, leg 108 extends from a generally polar region of the spheroidal portion 106. The leg preferably encloses an internal cavity that communicates with a main chamber formed in the spheroidal portion. The leg is initially used for dosing of the main chamber, and is subsequently closed at its outer end to maintain a hermetic seal of the fill received in the arctube body. The arctube body can be made of any light-transmissive material that can withstand the operating temperature and chemical reactions of the dose fill inside the lamp. Preferably, the arctube body 104 is made of quartz. More preferably, the arctube body 104 is made of a ceramic, which would have better life and performance than a quartz arctube body, as it can withstand higher, temperatures, and is more resistant to the chemical dose fill. In addition, the luminous intensity of the light source can be more uniform if a light-scattering ceramic material is chosen. Ceramic materials include oxide ceramics, non-oxide ceramics such as nitrides, carbides, and other non-metallic materials. Specifically, the ceramic material is light transmissive or translucent, and chosen from common lamp ceramic materials such as aluminum oxide, yttrium-aluminum garnet (YAG), yttrium oxide, dysprosium oxide, and other such materials. An induction coil 110 is preferably received about the spheroidal portion of the arctube body, namely first and second turns of a multi-turn coil are shown in FIGS. 1 and 3 as extending about an equatorial zone of the arctube body. The coil is connected to an electronics assembly or drive circuit 112 which provides the desired control of the discharge once initiation of the main fill starts. A toroidal-shaped discharge is created in the spheroidal portion of the arctube body.

To initiate the discharge, the leg 108 includes a starting wire 114 that also leads from the drive circuit 112 and initiates the discharge in the reduced dimension portion of the leg. A clamp or other securing means 116 (FIG. 3) is preferably provided on the leg to precisely orient the arctube body within the opening of the induction coil. Other similar methods of starting integrated with or attached to the leg 108 are also possible.

Because of the surrounding turns of the induction coil 110, most of the light is directed outwardly into the first and second polar regions or upper and lower hemispherical zones 120, 122 surrounding the arctube body. In area lighting applications, for example, a typical quartz metal halide is oriented in a vertical direction, i.e., the longitudinal axis of the cylindrical arc tube is disposed in a vertical direction so that light is essentially emitted in a horizontal direction. A surrounding reflector then directs the light in the desired directions. With the present arrangement, the light is essentially emanating from the light source at 90° relative to a typical orientation of a traditional quartz metal halide lamp. That is, light is directed outwardly from the arctube body into the first and second hemispherical zones 120, 122 which are vertically oriented relative to one another.

Figure 8:
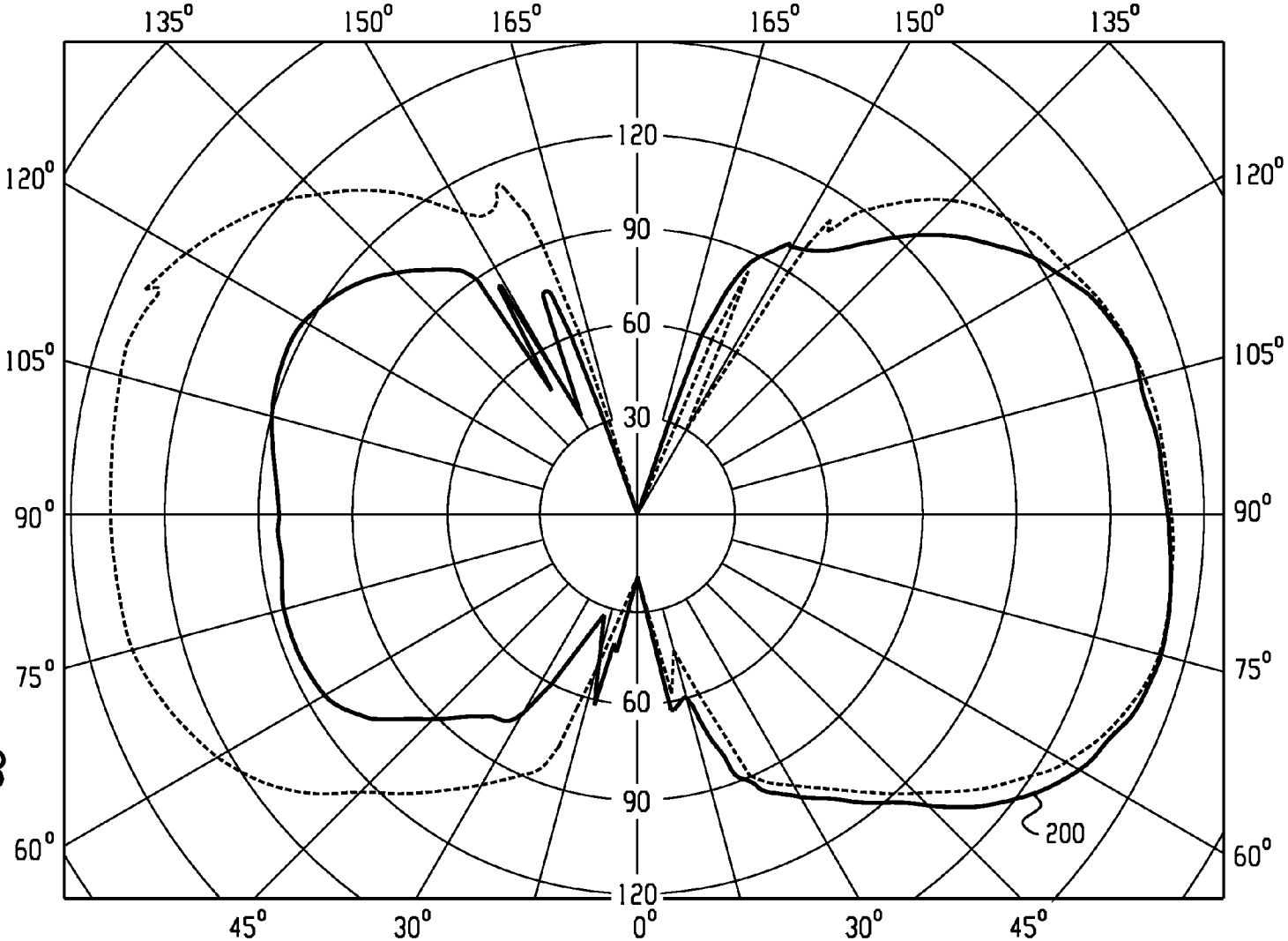
FIG. 8 shows the polar light intensity distribution of a common CMH lamp.
Figure 9:
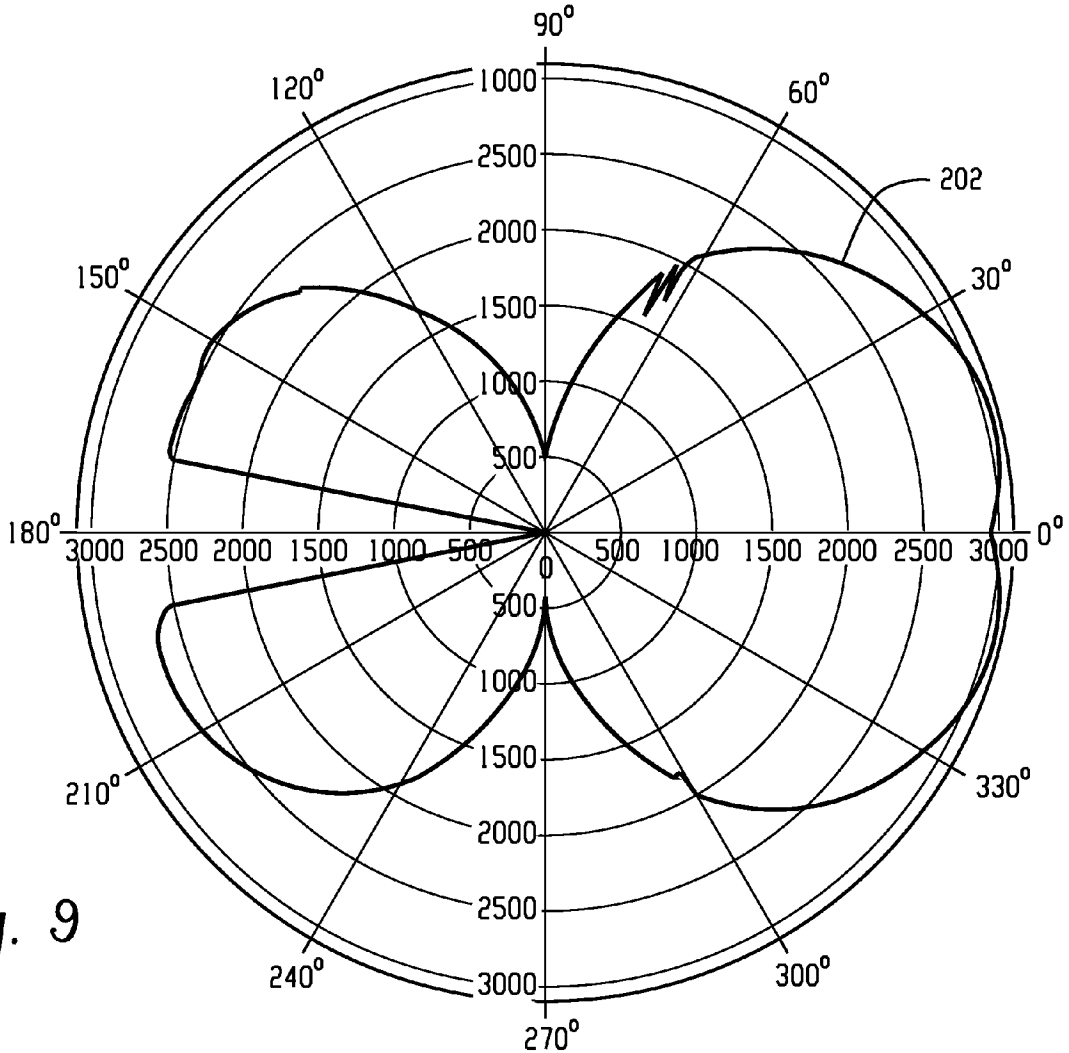
FIG. 9 shows the polar light intensity distribution of an electrodeless HID lamp.

FIG. 8 illustrates the light intensity distribution in polar angles of a traditional CMH lamp. FIG. 9 illustrates the light intensity distribution in polar angles of an electrodeless HID lamp. In the traditional CMH lamp distribution 200 (FIG. 8), the emitted flux is mainly emitted around the equator of the lamp, between the electrodes of the lamp where the discharge arc is located. Flux is obstructed by the lamp base, arctube legs, and electrodes of the lamp located along the vertical axis, blocking light in the direction of the apex and nadir of the lamp. In comparison, the light distribution of the electrodeless lamp 202 (FIG. 9) is almost orthogonal to a traditional HID lamp. With no light-blocking electrodes or lamp base, the electrodeless arctube body emits relatively evenly in all directions (the low intensity region in the apex of the distribution is an artifact of the measurement system). Light is obstructed in the electrodeless lamp by the induction coil, which is located approximately at the equator of the lamp. Hence, light is emitted in two roughly Lambertian lobes in the apex and nadir directions of the lamp. Commonly used optics for a traditional HID light source are generally located around the equator of the lamp, since the majority of the lamp flux is emitted around the equator, and this flux must be shaped into a useful distribution, such as an area light or spot light. One consequence of the design of traditional HID light sources is that the smallest amount of flux is emitted along the nadir direction due to the blocking of the lamp electrodes and legs. The exact opposite situation is present in the case of an electrodeless lamp, where the majority of the flux is emitted directly along the vertical axis of the lamp, in the apex and nadir directions. Clearly, a novel optical solution is needed to effectively and efficiently shape the different light distribution emitted from an electrodeless lamp.

A light distribution assembly 100 of the present disclosure includes a first shaped optical element, reflector, or reflector portion 136 (FIG. 1) that directs light primarily received from the upper, apex, or first hemispherical zone 120 into a first, forward, or in this case, nadir direction in the second hemispherical zone 122. Similarly, a second optical element, reflector, or reflector zone 132 is disposed at the nadir of the light source, which controls light primarily received from the lower, or second hemispherical zone 122. Both the first optical element 136 and the second optical element 132 can be augmented by a third optical element, reflector, or another reflector portion 134. The third optical element 134 primarily directs light from the upper hemispherical zone that is along the vertical axis and directs it towards the first optical element 136 or through a first or open end 140 of the main reflector. The second and third optical elements 132, 134, respectively, are preferably simple geometric shapes such as a cone-shaped funnel, while the first reflector zone 136 may be a more complex shape such as the parabolic-type reflector. Higher complexity designs for the forward and rearward components 132 and 134, such as curved shapes, parabolic reflectors or collimators, refractors, and the like, may provide improved optical control at the cost of manufacturing cost and simplicity. In addition, openings, perforations, or partially reflective and transmissive coatings may be applied to the second optical element 132 to further tailor the light output. For example, the illuminance below the light assembly may be reduced too much by an opaque second optical element. Since the flux required to generate illuminance is at a minimum at the nadir of the light assembly, the optical element could be made slightly transmissive via coating, perforation, or other means, to let an appropriate amount of light through the optic to improve the illumination pattern. Various combinations of these optical elements can be used to generate the desired illumination output from the lighting system. At a minimum, the first 136 and second 132 components will be required to create a uniform output. At the cost of manufacturability, and optical design modularity, the first 136 and third 134 components can be combined into a single element. The second 132 optical element reflector portion may be added or modified to tailor the distribution to a specific application or requirement. Commonly, the second optical element 132 is used to redistribute the on-axis nadir light and avoid a high illuminance point directly below the lighting assembly. Typically in a horizontal plane orthogonal to the vertical axis cut through the lighting system 130, any one or more of the optical elements may have a cross-section that is circular, or polygonal, or having curved or straight segments, or any combination of segments that can be rotationally symmetric or rotationally non-symmetric.

Figure 2:
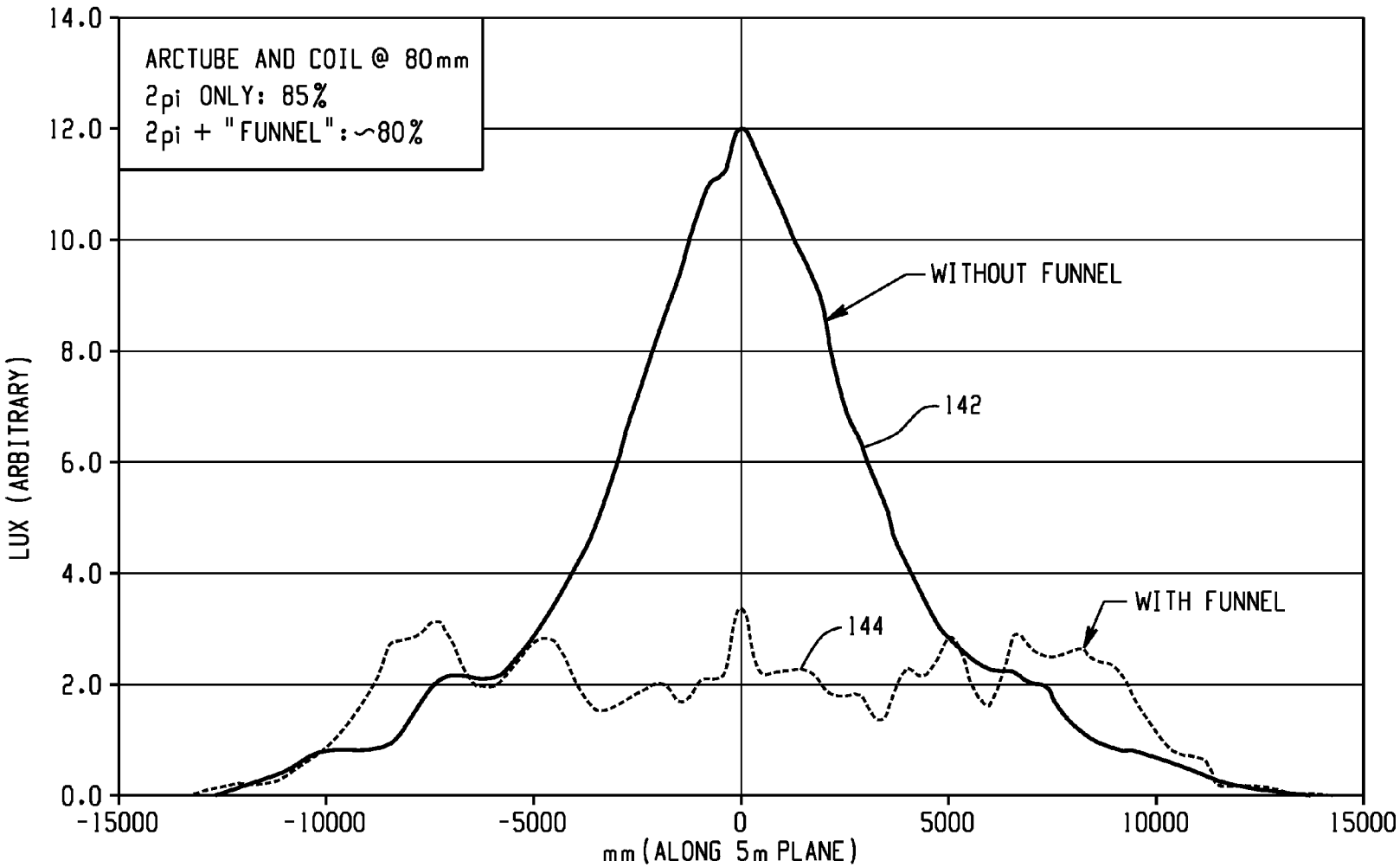
FIG. 2 is a graphical representation of improved illuminance properties associated with the assembly of FIG. 1.

The graphical representation of FIG. 2 provides an illustration of the light associated with the reflector portion 136 only (curve 142) versus the light associated with the light distribution assembly 130 that incorporates optical elements 132, 134, 136 as represented by curve 144. As is evident, with only the single reflector portion 136 which is similar to the optical system used in a traditional HID lighting system, a large central peak results, meaning that a large portion of the on-axis light exiting the light source is directed downwardly and only closely adjacent about the light pole. This results in a very large maximum illumination level, and a non-uniform illumination pattern with areas of low illumination at the edges. This drives the ratio of maximum to minimum illumination to very high levels. This is not desired as the human eye will adjust to the highest level of illuminance, which will make the lit areas at the minimum illuminance appear dark, though they are technically at an acceptable illumination level. Therefore, there is a need to direct portions of the light emitted from the electrodeless lamp near the optical axis outwardly to the edges of the region below the light pole and as evident in curve 144. Thus, the central portion of the light distribution is substantially reduced (to approximately 3.0 lux) while those portions at plus or minus 10,000 millimeters will also receive light between 2-3 lux. This means that a large portion of the light is distributed more evenly across the ground surface by incorporating the second and third optical elements 132, 134 into the distribution assembly. The max:min illumination ratio for the optical system with only the first optical element 136 is approximately 12:1 with a minimum illumination level of 1.0 lux, while adding optical elements 132 and 134 reduce this to approximately 2:1 with a minimum illumination level of 1.5 lux.

Figure 12:
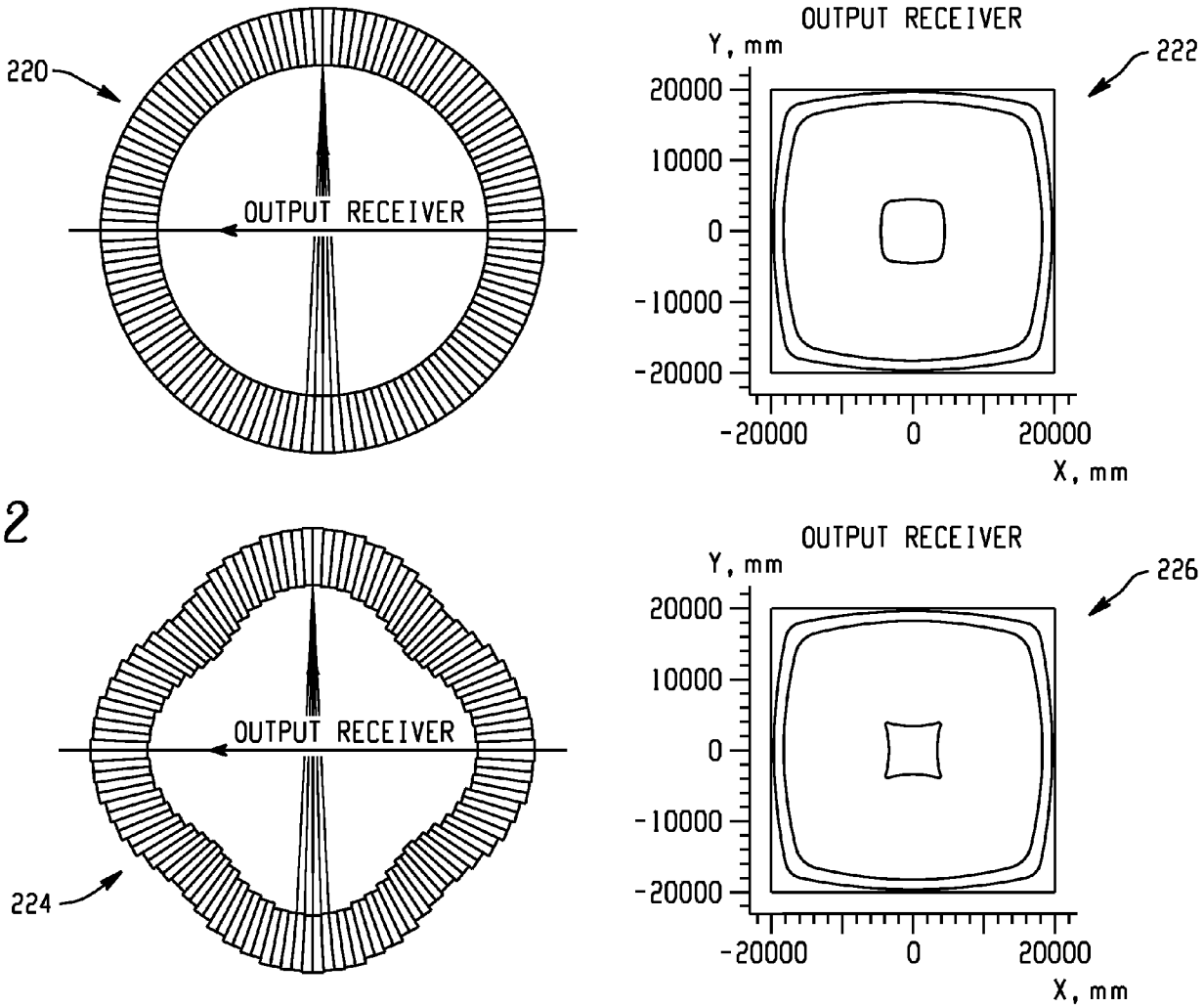
FIG. 12 shows the effect of shaping the first optical element in the horizontal plane on the resultant illuminance pattern for a uniform area lighting application.

FIG. 12 shows the illumination pattern generated solely from the first optical element 136 with two different cross-sectional shapes in the horizontal plane of a typical 120'×120' parking lot application. A circular cross-section 220 is similar to traditional optics. However, when attempting to illuminate a square surface, regions of lower illuminance are generated along the diagonals of the illumination surface 222 (shown as dark lines). This results in a max:min illuminance ratio of approximately 4:1. In comparison, when a shaped design, or "cloverleaf" cross-sectional shape 224 is used, the illuminance pattern 226 becomes much more uniform, and the regions of low illuminance along the diagonals are removed. In this case the max:min illuminance ratio is approximately 2:1.

Figure 4:
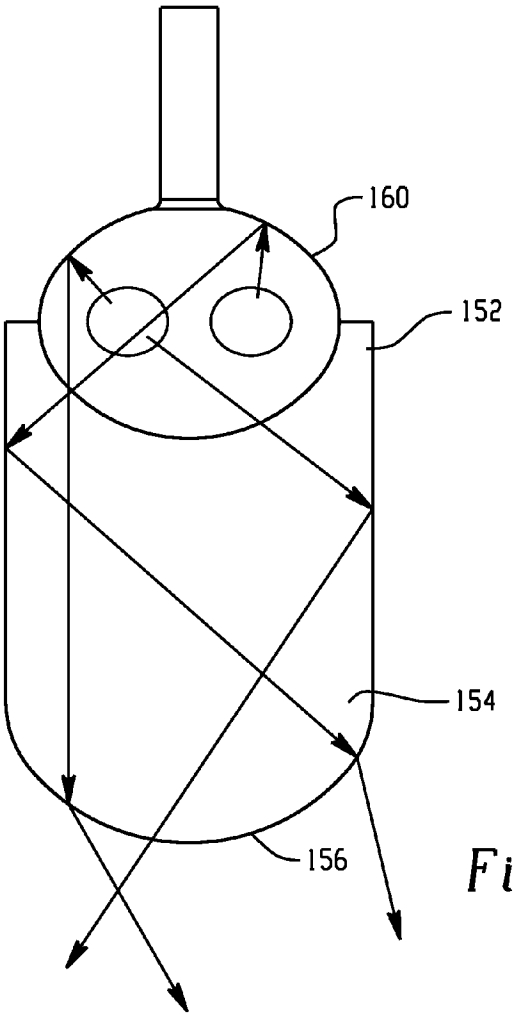
FIG. 4 is an enlarged elevational view of a portion of the lamp assembly of FIG. 3 and illustrating exemplary light ray traces.
Figure 5:
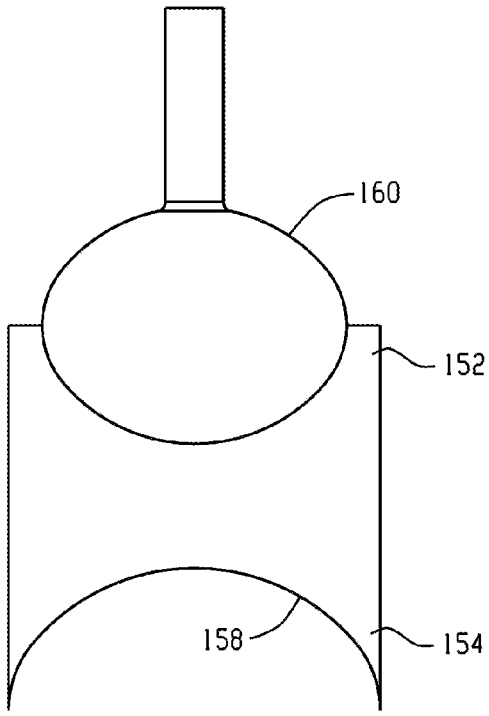
FIG. 5 is an elevational view of an alternative configuration of compact beam forming optics for an electrodeless lamp.

For lighting applications such as spot or flood lighting of sporting arenas and stadia, a compact beam former assembly shown in FIGS. 3, 4, and 5 preferably takes the form of a first optical element in the form of a reflective coating 160 on the arctube body that redirects light from the first hemispherical zone 120 back through the arctube body to be re-emitted into the second hemispherical zone 122 so that all of the light is directed into the second hemispherical zone and through a second beam forming optical element in the form of a quartz or glass, generally cylindrical optical structure or optic member 150. The first optical element 160 is optically close-coupled to the electrodeless arctube body, and may be a reflector coating directly applied to the surface of the arctube body, or another reflective element positioned in close proximity to the arctube body, as to redirect a substantial portion of the light into the second hemispherical zone. As more particularly evident in FIG. 4, a first end 152 of the second optical element is disposed adjacent the surface of the arctube body that is facing the second hemispherical zone. Preferably the first end 152 of the optic member adopts the same or substantially the same conformation as the surface of the arctube body that is facing the second, or lower, hemispherical zone and thus collects light over a solid angle having roughly 2 pi steradians in the lower nadir hemispherical zone. A second end 154 spaced from the arctube body can adopt different configurations as illustrated in FIG. 4 (convex surface 156) and in FIG. 5 (concave surface 158).

As best illustrated in FIG. 4, most light rays from the toroidal discharge in the arctube body will exit the arctube body into the second hemispherical zone. These rays are then reflected or totally internally reflected through the beam forming second optical element 150 and exit the second end 154 in a controlled beam. The second end 154 can adopt an alternative shape, such as the concave surface 158 of FIG. 5, in order to alter the beam pattern if so desired. The beam forming second optical element 150 could also be a hollow reflector with a reflective coating, partially coated, or made of standard reflector materials, such as quartz, glass, ceramic, metal, or plastic.

Figure 6:
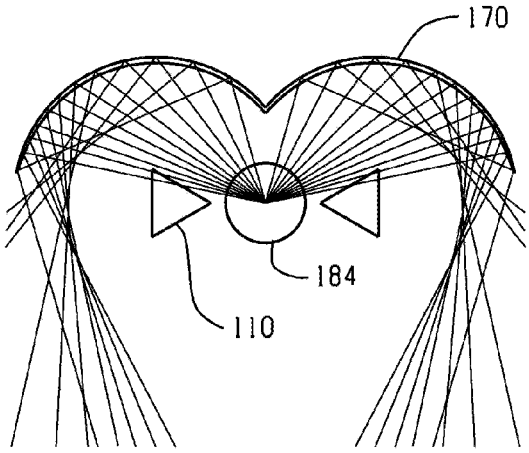
FIG. 6 is an elevational view of an alternative configuration of a light assembly.

As shown in FIG. 6, the first directional optical element 160 can also be in the form of a reflective coating on the surface of the arctube body that is facing the second hemispherical zone 122 so that all of the light is directed through the first hemispherical zone in the upward rather than downward direction. The second optical element 170 then creates a uniform illuminance pattern in the downward direction. This has the advantage of simplicity, due to lower number of components, and ease of fabrication. Preferably, if combined with a reflective coating 160, or close-coupled reflector as described above on the surface of the arctube body that is facing the second hemispherical zone, this arrangement results in a lighting system with a single optical component 170 external to the arctube body 104. Alternatively, an optical component (not shown) can be positioned directly below the arctube body 104 to direct all of the emitted light in the vertical up direction toward the optical element 170 and serve the same purpose as the reflective coating 184.

Figure 7:
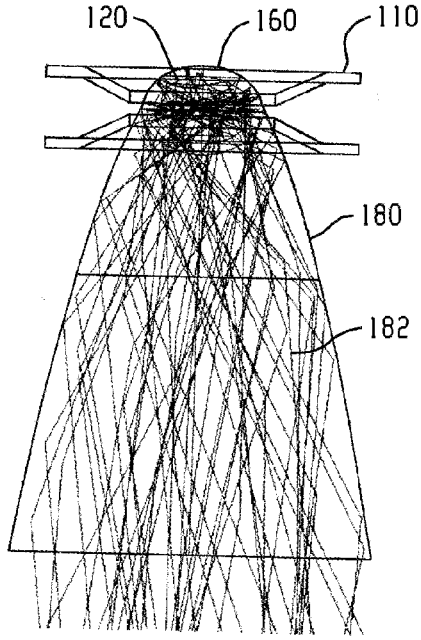
FIG. 7 is an elevational view of an alternative configuration of compact beam forming optics for an electrodeless lamp.

As an alternate optical portion to control the light emitted into the first 120 and second 122 hemispherical zones, an optical element in the form of a reflective coating may be placed near or on the surface of the arctube body 104. For example, FIG. 7 illustrates placement of the reflective coating 160 on or adjacent the surface of the arctube body that is facing the second hemispherical zone. This will control the light emitting into that hemisphere, replacing the need for an external reflector optic. Coatings that cover a fraction of one hemisphere or slightly more than the single hemisphere are also envisioned to ensure efficient coupling into the second optical element. FIG. 7 further illustrates use of a second optical element in the shape of a compact beam former, which is pictured as a parabolic reflector (PAR) 180 brought into close proximity with the arctube body. The light ray traces 182 demonstrate the control of the light output from the lamp. The close-coupled optic will provide an incredibly small total optical system that would be significantly smaller than traditional HID systems. For example, a traditional 400 W QMH jacketed lamp is roughly 4" in diameter and 10" in length. Since the optics must be placed around the lamp, the total size of the optical elements is approximately two times (2×) the size of the lamp (~20"). In comparison, the electrodeless lamp and coil are roughly 3" in diameter, and 1" in height. The optics pictured in FIGS. 7 and 10 result in a beam forming optics and lamp that measure approximately 5" in diameter and 6" in total height. This is a two order of magnitude reduction in the volume of the optics, which would reduce the cost of placing the light source in application, such as outdoor lighting, and also reduce the material costs of the system. Other reflector shapes, such as elliptical, hyperbolic, compound parabolic concentrator, or combinations of these and other shapes are also envisioned for the second optical element to create compact beam forming optics.

Figure 10:
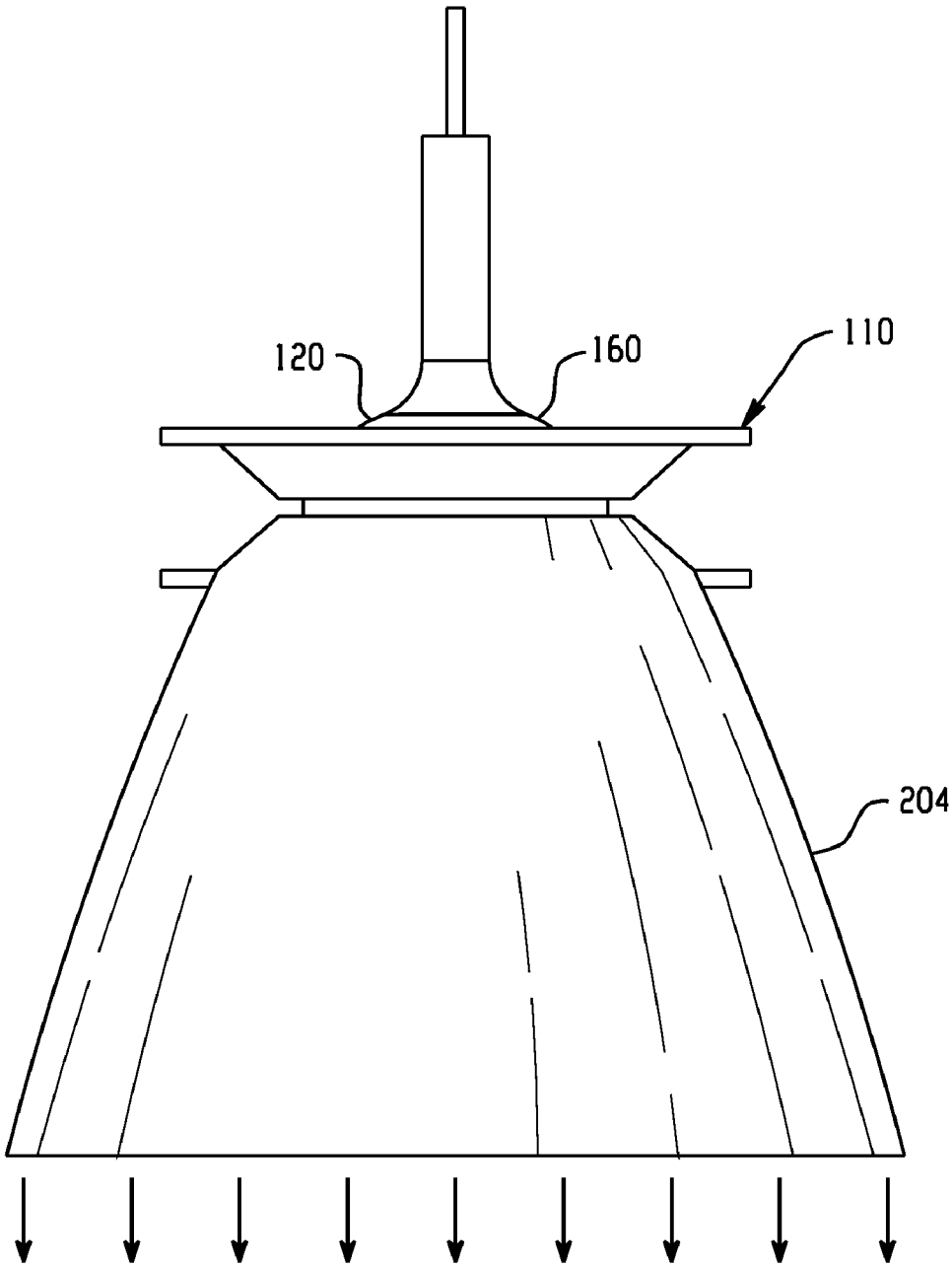
FIG. 10 shows an alternative configuration of compact beam forming optics for an electrodeless lamp.

FIG. 10 shows an alternate embodiment of the optical system shown in FIG. 7. A first optical element in the form of a reflective coating 160 is placed on or adjacent the surface of the arctube body that is facing the first hemispherical zone 120, surrounded by an induction coil 110. Coupled to the bottom of the induction coil is a second optical element in the shape of a PAR or other type reflector 204, which directs the light into a tight beam spot. In addition, the shape of the induction coil could be tapered or formed to mate with and contribute to the attached reflector shape as desired.

Figure 11:
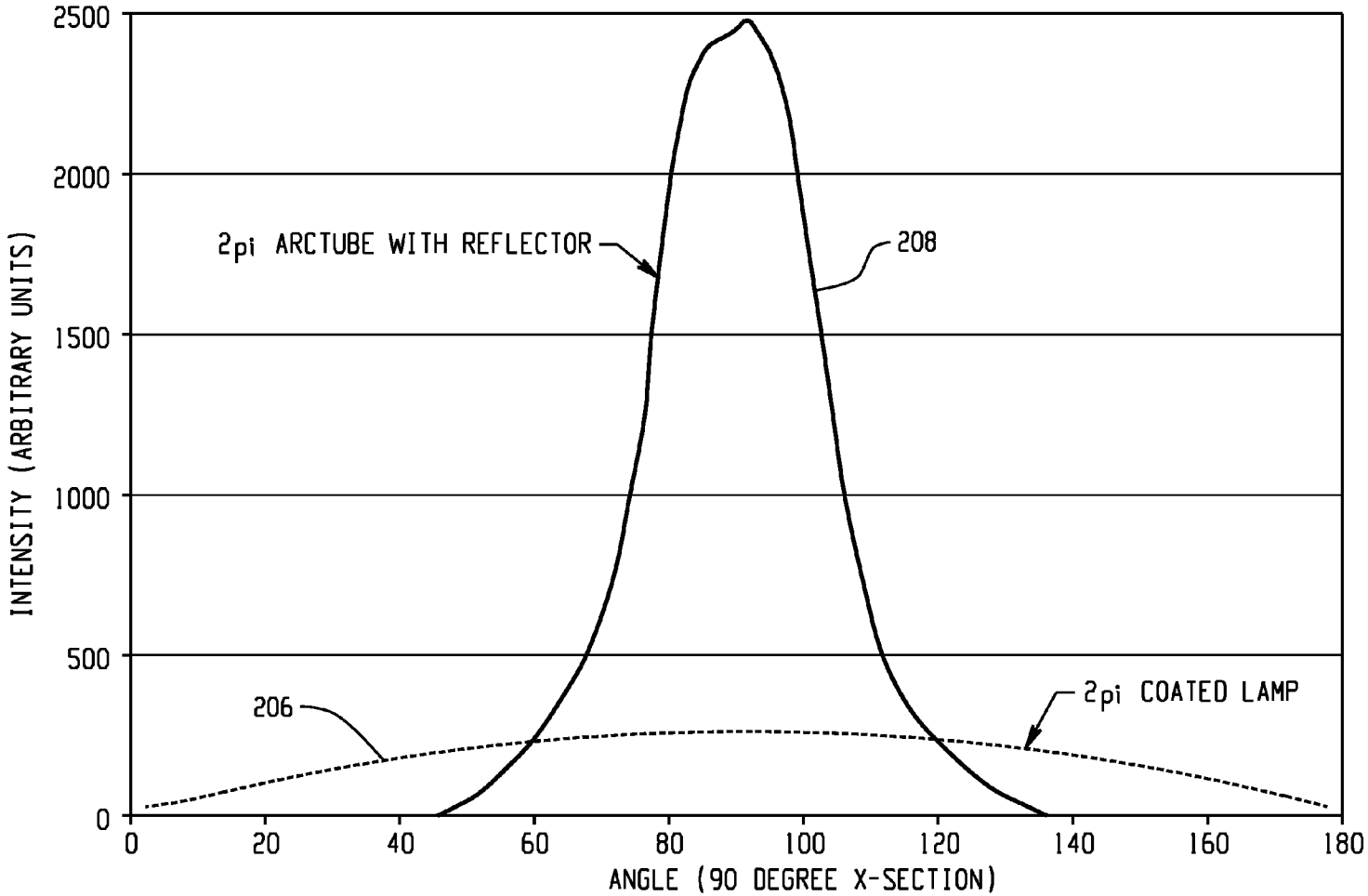
FIG. 11 shows the light intensity distribution of an electrodeless lamp in comparison with the same lamp surrounded by the beam forming optics of FIG. 10.

FIG. 11 shows the light intensity distribution of the optical embodiment in FIG. 10. The lamp 120 with first optical element 160 and induction coil 110 is shown as line 206. This is a roughly Lambertian light distribution into the hemisphere in the nadir direction below the lamp. Curve 208 shows the beam pattern when a second optical element in the shape of a PAR reflector 204 is placed in close proximity to the bottom of the induction coil. The completely uncontrolled light flux 206 is converted into a spot beam having approximately a 30-degree beam angle, defined by the full width at half maximum intensity, FWHM. This is an extremely simple method to create a useful light output with a minimum of material and cost. Other optical reflectors, or couplers are envisioned in different orientations, such as a reflector around the coil, closely-coupled to the lamp, as shown in FIG. 7, or others that collect the emitted flux from the bottom of the lamp and coil.

This disclosure leverages the high brightness of an induction HID arctube body relative to a standard CMH arctube body and provides a very compact beam forming assembly using combinations of first and second optical elements around the electrodeless HID lamp, which direct the light into a forward direction, then form a useful beam, respectively. The size, weight, and complexity of the luminaire can be significantly reduced, and the luminaire can be more easily packaged into the lamp assembly. The second beam forming optic is preferably a solid or hollow quartz cylindrical shape which may be coated with a reflector on its outside surface, may have tapered sidewalls, and operates similar to a compound parabolic collector (CPC) or parabolic aluminized reflector (PAR) 184. The solid quartz optic is located in close proximity, below the second hemispherical zone 122 of the light source to efficiently couple the maximum amount of flux from the arctube body. The first directional optical element is preferably a reflective coating 160 on the surface of the arctube body that is facing the first hemispherical zone 122 to direct the light downwardly into a solid angle of 2 pi or less steradians for collection and beam forming by a second optical element or reflector. Similarly, an equivalent directional optical element in the form of a reflective coating 184 is envisioned on the bottom of the lamp to direct the light upwardly into a solid angle of 2 pi or less steradians for collection and beam forming by a second optical element or reflector. Moreover, the function of the second optical element is to collect as much usable light from the lamp into the smallest possible circular plane below the lamp. At that plane, additional optics, such as refractive (lens) or reflective (mirror) optics can be placed to tailor the shape of the beam. For example, spot, flood, rectangular, asymmetric, or other beam patterns can be achieved.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. A light distribution assembly for controlling light from an electrodeless high intensity discharge lamp comprising:

an electrodeless high intensity discharge light source providing emitted light into substantially first and second hemispherical zones;

a first optical element redirecting at least a portion of light from the first hemispherical zone into a first desired direction in the second hemispherical zone;

a second optical element that redirects at least a portion of light within the second hemispherical zone that includes at least a portion of the light that was redirected by the first optical element.

2. The light distribution assembly of claim 1 wherein the light source is a ceramic electrodeless high intensity discharge lamp.

3. The light distribution assembly of claim 1 further comprising a third optical element which redirects at least a portion of light from the first hemispherical zone.

4. The light distribution assembly of claim 1 where the first optical element also redirects at least a portion of light from the second hemispherical zone.

5. The light distribution assembly of claim 1, wherein the first and second optical elements which generates a substantially uniform illuminance distribution.

6. The light distribution assembly of claim 5 wherein the second optical element reduces the on-axis nadir light intensity.

7. The light distribution assembly of claim 6 where the second optical element has a conical shape.

8. The light distribution assembly of claim 7 further comprising a third optical element having a conical shape, which redirects at least a portion of the light from the first hemispherical zone.

9. The light distribution assembly of claim 5, wherein the first optical element has a non-circular cross-sectional shape.

10. The light distribution assembly of claim 1 which generates a directional spot beam pattern.

11. The light distribution assembly of claim 10 which generates a directional spot beam pattern with a beam angle of less than 60°.

12. The light distribution assembly of claim 10 which generates a directional beam pattern with a beam angle of less than 30°.

13. The light distribution assembly of claim 1 wherein the first optical element is a reflector or coating which is optically close-coupled to the surface of the arctube body that is facing the first hemispherical zone.

14. A light distribution assembly for controlling light from an electrodeless high intensity discharge lamp comprising:

an electrodeless high intensity discharge light source providing emitted light into substantially first and second hemispherical zones;

a first optical element redirecting at least a portion of light from the first hemispherical zone into a first desired direction in the second hemispherical zone, and the first optical element is a reflector or coating which is optically close-coupled to the surface of the arctube body that is facing the first hemispherical zone:

a second optical element that includes a reflector that redirects a portion of light within the second hemispherical zone that includes at least a portion of the light that was redirected by the first optical element.

15. The light distribution assembly of claim 14 wherein the second optical element is a parabolic or elliptical or other curved reflector.

16. The light distribution assembly of claim 14 where the reflector or coating is on at least one half of the surface of the arctube body.

17. The light distribution assembly of claim 14 where the second optical element comprises a solid optical block.

18. The light distribution assembly of claim 17 wherein a first end of the optical block has a conformation that mates with an external surface of the arctube body of the electrodeless lamp.

19. The light distribution assembly of claim 17 wherein a second end of the second optical element spaced has a convex surface.

20. The light distribution assembly of claim 17 wherein a second end of the second optical element spaced has a concave surface.

21. The light distribution assembly of claim 17 wherein the optical block is dimensioned for receipt inside an induction coil that drives the light source and is immediately adjacent the arctube body.

22. A light distribution assembly for controlling light from an electrodeless high intensity discharge lamp comprising:

an electrodeless high intensity discharge light source providing emitted light into substantially first and second hemispherical zones;

a first optical element redirecting at least a portion of light from the second hemispherical zone into a first desired direction in the first hemispherical zone; and a second optical element that redirects at least a portion of light into a second desired direction within the second hemispherical zone, the first and second optical elements generating a substantially uniform illuminance distribution.

23. A light distribution assembly for controlling light from an electrodeless high intensity discharge lamp comprising:

an electrodeless high intensity discharge light source providing emitted light into substantially first and second hemispherical zones;

a first optical element redirecting at least a portion of light from the first hemispherical zone into a first desired direction in the second hemispherical zone;

a second optical element that redirects at least a portion of light within the second hemispherical zone; and a third optical element which redirects at least a portion of light from the first hemispherical zone.

* * * * *